US008820993B2

(12) United States Patent
Kloos

(10) Patent No.: US 8,820,993 B2
(45) Date of Patent: Sep. 2, 2014

(54) PROJECTION HEADLIGHT WITH RECESSED LIGHT BEAM PRODUCING SECTION

(75) Inventor: Gerhard Kloos, Erwitte (DE)

(73) Assignee: Hella KGAA Hueck & Co., Lippstadt (DE)

( * ) Notice: Subject to any disclaimer, the term of this patent is extended or adjusted under 35 U.S.C. 154(b) by 72 days.

(21) Appl. No.: 13/456,717

(22) Filed: Apr. 26, 2012

(65) Prior Publication Data

US 2012/0275168 A1 Nov. 1, 2012

(30) Foreign Application Priority Data

Apr. 29, 2011 (DE) ..... 10 2011 002 337

(51) Int. Cl.
*F21V 11/00* (2006.01)

(52) U.S. Cl.
USPC ..... 362/539; 362/509

(58) Field of Classification Search
USPC ..... 362/351, 538, 539, 507, 509, 516, 520
See application file for complete search history.

(56) References Cited

U.S. PATENT DOCUMENTS

| | | | | |
|---|---|---|---|---|
| 8,201,981 | B2 * | 6/2012 | Brendle et al. | 362/538 |
| 8,459,849 | B2 * | 6/2013 | Grimm et al. | 362/539 |
| 2004/0170847 | A1 | 9/2004 | Lefevre et al. | |
| 2005/0025904 | A1 | 2/2005 | Giroud | |
| 2010/0177525 | A1 | 7/2010 | Iwasaki | |
| 2010/0226142 | A1 * | 9/2010 | Brendle et al. | 362/512 |
| 2012/0014125 | A1 * | 1/2012 | Uchida | 362/538 |

FOREIGN PATENT DOCUMENTS

| | | | |
|---|---|---|---|
| DE | 10338840 | A1 | 1/2006 |
| DE | 102005041196 | A1 | 3/2007 |
| DE | 102008039930 | A1 | 3/2010 |
| JP | 2008077890 | A | 4/2008 |
| JP | 2010165474 | A | 7/2010 |

OTHER PUBLICATIONS

Feb. 10, 2012 German Search Report.

* cited by examiner

*Primary Examiner* — John A Ward
(74) *Attorney, Agent, or Firm* — Husch Blackwell LLP

(57) ABSTRACT

Projection headlights for vehicles with a reflector, with a light source assigned to the reflector, with a lens arranged in the main direction of the beam in front of the reflector and with a screen arranged in the region of the focal point of the lens, said screen being arranged between the light source and the lens and comprising an elongated screen edge surface having a contour on an upper edge in order to form a light/dark boundary of a light distribution arrangement, wherein the elongated screen edge surface comprises a light beam reduction section in a middle area, so that at least part of the light beam emitted from the light source and hitting the light beam reduction section is not further reflected in the main direction of the beam, wherein the light beam reduction section is designed as a recess.

10 Claims, 2 Drawing Sheets

PROJECTION HEADLIGHT WITH RECESSED LIGHT BEAM PRODUCING SECTION

CROSS REFERENCE TO RELATED APPLICATIONS

This application claims priority to DE 10 2011 002 337.2 filed on Apr. 29, 2011.

BACKGROUND

Projection headlights for vehicles with a reflector, a light source assigned to the reflector as well as a screen and a lens are disclosed in DE 10 2005 041 196 A1, said projection headlights comprising a light beam reduction section in the vicinity of a light/dark boundary of the light distribution arrangement on an elongated screen edge surface of the screen to reduce an undesirable glare effect. Said light beam reduction section is designed with a frosted or corrugated surface, which is relatively difficult to be manufactured.

Therefore, an object of the present invention is to upgrade projection headlights in such a way that a glaring effect caused by a light beam hitting a screen edge surface of the screen is eliminated in a simple manufacturing manner.

SUMMARY OF THE INVENTION

To solve this object, the invention is characterized in that the light beam reduction section is designed as a recess.

The invention relates to projection headlights for vehicles with a reflector, with a light source assigned to the reflector, with a lens arranged in the main direction of the beam in front of the reflector and with a screen arranged in the region of the focal point of the lens, said screen being arranged between the light source and the lens and comprising an elongated screen edge surface having a contour on an upper edge in order to form a light/dark boundary of a light distribution arrangement, wherein the elongated screen edge surface comprises a light beam reduction section in a middle area, so that at least part of the light beam emitted from the light source and hitting the light beam reduction section is not further reflected in the main direction of the beam.

According to the invention, the light beam reduction section is designed as a recess, which seemingly "swallows" a light beam hitting it. The recess forms a continuous cavity or opening with which a local reflection suppression is created. For example, the recess can also be designed as a channel-like opening with side walls on which the incident light is diverted away from the screen edge surface.

According to a preferred embodiment of the invention, the recess is arranged in such a middle area of the screen edge surface that an illuminance reduction area is created above the light/dark boundary in a central area of the light distribution arrangement. As a result, the illuminance is reduced in a kinked area of the light/dark boundary and deglaring is achieved above the latter.

According to an upgrade of the invention, the recess is arranged in such a way that the position of the light/dark boundary does not change because of the presence of the recess. The light-related requirements can therefore be complied with.

According to an upgrade of the invention, the recess can be created by way of electrothermal removal, in particular spark erosion. Advantageously, this allows the realization of a defined shape of the recess.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Exemplary embodiments of the invention are explained in more detail below by means of drawings.

In the figures.

DETAILED DESCRIPTION

Figure 1:
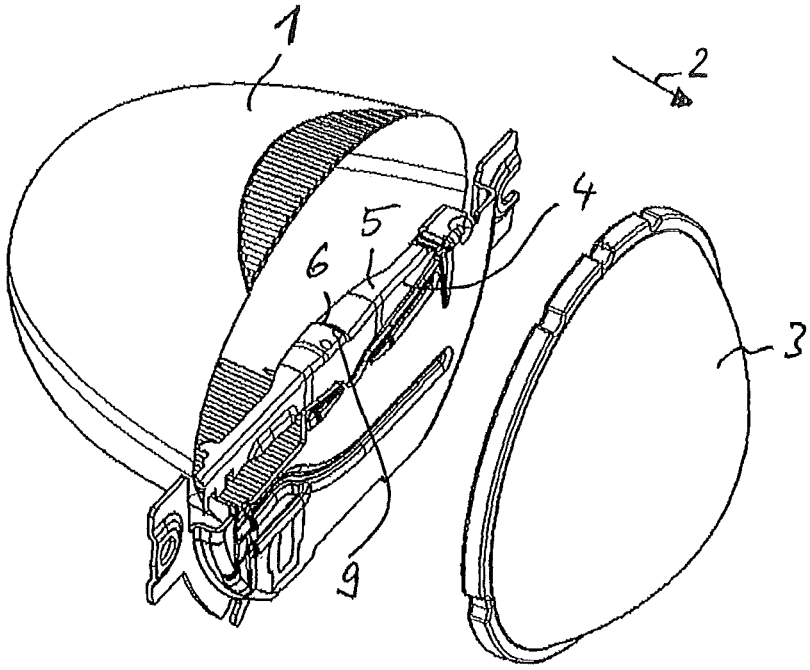
FIG. 1 shows a perspective side view of projection headlights with a screen according to the invention.

Projection headlights for vehicles comprise a reflector 1, a light source assigned to the reflector 1, a lens 3 arranged in the main direction of the beam 2 in front of the reflector 1 as well as a screen 4, arranged in the area of a focal point of the lens 3.

Normally, the screen 4 is arranged between the light source and the lens 3. On an upper edge of a screen edge surface 5 having a contour, the screen 4 comprises an elongated screen edge surface 5, by means of which a light/dark boundary HDG of a light distribution arrangement, in particular a low beam arrangement AL2 can be depicted. The screen 4 can for example be pivotably mounted on a further rigid screen around a rotational axis running parallel to an optical axis of the reflector 1, so that a screen edge surface 5 of the rigid screen 4 is exposed by swinging down the screen 4 in order to create a high beam distribution arrangement.

Figure 3A:
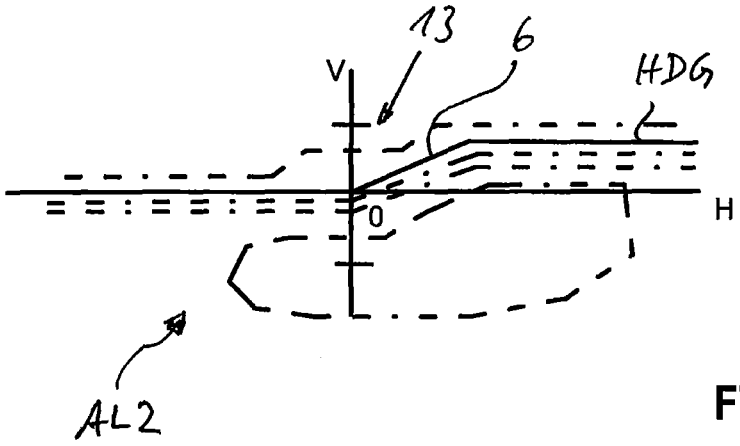
FIG. 3*a* shows a schematic view of a low beam arrangement of the projection headlights having a screen without a recess on a screen edge surface and FIG. 3*b* shows a schematic view of the low beam arrangement of the projection headlights with a recess arranged on the screen edge surface.
Figure 3B:
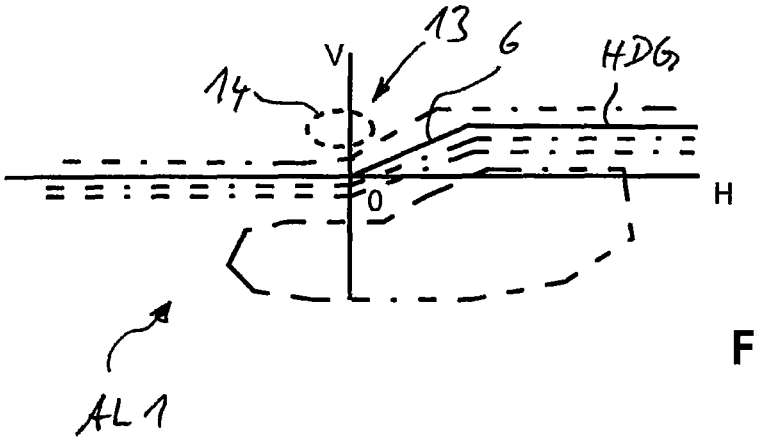

The screen edge surface 5 of the screen 4 comprises a 15° rising area 6 in one of its middle areas by means of which a sloping area 7 of a light/dark boundary HDG illustrated in FIGS. 3 *a* and 3 *b* can be depicted.

Furthermore, a light beam reduction section designed as a recess 9 is arranged in a middle area 8 of the elongated screen edge surface 5 containing the 15° rising area 6, said light beam reduction section being characterized in that a part of a light beam emitted by the light source hitting the recess 9 is not further reflected in the main direction of the beam 2 and hence cannot contribute to the low beam arrangement AL1.

According to a further embodiment of the invention, the recess 9 has an arched and/or spherical area 10, which extends from a preferably circular opening edge 11 of the recess 9 arranged on a top side 12 of the screen edge surface 5 to the top side 12 of the screen edge surface 5, by forming an indent. The arched area 10 is designed in such a way that rays of light or a light beam entering through a cross-sectional opening area of the recess 9 which is delimited by the opening edge 11, cannot exit the cross-sectional opening area again. For this purpose, the arched area 10 has a plurality of segmented free-form surfaces.

FIG. 3 *b* shows that in the presence of the recess 9 an illuminance reduction area 14 exists in a central area 13 of a low beam arrangement AL1 namely above the light/dark boundary HDG, in which the illuminance is considerably lower than in the same local area of a low beam arrangement AL1 according to FIG. 3 *a*. In the illuminance reduction area 14 of the low beam arrangement AL1, the illuminance can for example be 0.07 lx, while an illuminance of 0.57 lx is measured in the same area of the low beam arrangement AL2 without the presence of the recess 9.

The recess 9 is arranged on a side of the screen edge surface facing the lens, wherein the gradient and/or the position of the light/dark boundary HDG do not change because of the presence of the recess 9.

The recess 9 can be created by way of electrothermal removal, in particular spark erosion. An electrode of a hobbing device is lowered onto the screen edge surface made of a sheet steel material and surrounded by an insulator, so that material can be removed from the screen 4 by spark formation.

Figure 2:
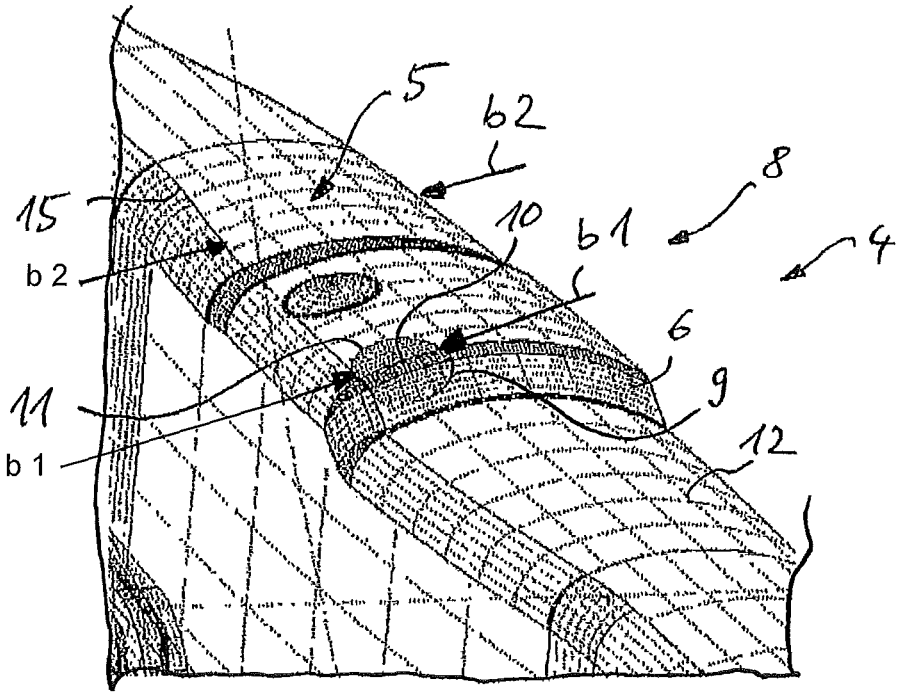
FIG. 2 shows an enlarged representation of a screen edge surface of the screen in a middle area of the latter.

As illustrated in FIG. 2, the recess 9 is located directly on an upper longitudinal edge 15 of the screen 4 which is delimiting the screen edge surface 5. The recess has a width b1 which is smaller than a width b2 of the elongated screen edge surface 5.

According to an alternative embodiment which is not shown, the recess can also comprise a channel-like indent which has cylinder-shaped longitudinal areas leading beyond the rays of light. The recess can for example be designed as an elongated hole.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

The invention claimed is:

1. A projection headlight screen for projection headlights with a reflector, with a light source assigned to the reflector, with a lens arranged in the main direction of the beam in front of the reflector, comprising:

a screen;

said screen being arranged in the region of the focal point of the lens between the light source and the lens;

said screen having an elongated screen edge surface having a contour on an upper edge in order to form a light/dark boundary of a light distribution arrangement;

said elongated screen edge surface comprising a light beam reduction section in a middle area, so that at least part of the light beam emitted from the light source and hitting the light beam reduction section is not further reflected in the main direction of the beam; and said light beam reduction section being a recess.

2. The projection headlight screen according to claim 1, wherein the light beam entering said recess through a cross-sectional opening area of said recess is not reflected back out through said cross-sectional opening area.

3. The projection headlights screen according to claim 1, further comprising said recess being in a middle area of said screen edge surface said screen edge surface having an illuminance reduction area above a light/dark boundary in a central area of a light distribution arrangement.

4. The projection headlights screen according to claim 1, characterized in that said recess being arranged in such a way that the light/dark boundary has the same gradient, irrespective of the presence of or absence of the recess.

5. The projection headlight screen according to claim 1, characterized in that said recess is on a side of the screen edge surface facing the lens.

6. The projection headlight screen according to claim 1, characterized in that said recess has a circular opening edge.

7. The projection headlight screen according to claim 1, characterized in that said recess is formed by electrothermal removal.

8. The projection headlight screen according to claim 1, characterized in that said recess is formed by spark erosion.

9. The projection headlight screen according to claim 1, characterized in that said recess comprises an arched area, extending from an opening edge of said recess to an area of the screen edge surface.

10. The projection headlight screen according to claim 1, characterized in that said recess has a width that is smaller than a width of the screen edge surface.

* * * * *